US006371001B1

(12) United States Patent
Schmid

(10) Patent No.: US 6,371,001 B1
(45) Date of Patent: Apr. 16, 2002

(54) MINE-CLEARING APPARATUS

(76) Inventor: Josef Schmid, Wenton 18, A-3343 Hollenstein/Ybbs (AT)

( * ) Notice: Subject to any disclaimer, the term of this patent is extended or adjusted under 35 U.S.C. 154(b) by 0 days.

(21) Appl. No.: 09/586,495

(22) Filed: Jun. 2, 2000

(30) Foreign Application Priority Data

Jun. 2, 1999 (AT) ..... 987/99

(51) Int. Cl.[7] ..... B02C 4/20

(52) U.S. Cl. ..... 89/1.13; 172/118; 172/122; 172/547

(58) Field of Search ..... 89/1.13; 172/112, 172/117, 118, 119, 122, 123, 547, 548; 241/101.74, 101.742, 188.1, 189.1

(56) References Cited

U.S. PATENT DOCUMENTS

| | | | | | |
|---|---|---|---|---|---|
| 1,258,882 | A | * | 3/1918 | Dremel | 89/1.13 |
| 2,489,349 | A | * | 11/1949 | White | 89/1.13 |
| 5,442,990 | A | * | 8/1995 | Krohn | 89/1.13 |
| 5,503,340 | A | * | 4/1996 | Doppstadt | 241/189.1 |
| 5,875,980 | A | | 3/1999 | Schmid | 241/101.742 |
| 5,936,185 | A | * | 8/1999 | Tokuni | 89/1.13 |

FOREIGN PATENT DOCUMENTS

| | | | | |
|---|---|---|---|---|
| DE | 2430709 | * | 1/1976 | 89/1.13 |

* cited by examiner

*Primary Examiner*—Stephen M. Johnson
(74) *Attorney, Agent, or Firm*—Herbert Dubno; Andrew Wilford

(57) ABSTRACT

An apparatus for clearing mines set in the ground has a vehicle body adapted to travel along the ground in a horizontal travel direction, a drum mounted at a front end of the body and rotatable in a rotational sense about a horizontal axis generally perpendicular to the direction, and an array of radially outwardly projecting chisels mounted on the drum. A support mounted on the body spaced from the drum is at least partially displaceable on the body radially relative to the drum. Springs braced between the body and the support hold the support in a standard position at a predetermined radial spacing from the drum and permit deflection of the support radially away from drum. A plurality of vertically spaced breaker bars are mounted on the support spaced from the drum. The drum is forcibly rotated about the axis in the rotational sense with a front side of the drum moving upward and a rear side of the drum moving downward for engaging the chisels and elements with rocks and mines on and in the ground, detonating mines in the ground, picking up the rocks and undetonated mines, and comminuting the rocks and crushing the undetonated mines against the breaker bars so that a mine detonating between the drum and the support will deflect the support against the springs away from the axis.

10 Claims, 1 Drawing Sheet

MINE-CLEARING APPARATUS

FIELD OF THE INVENTION

The present invention relates to a mine-clearing apparatus. More particularly this invention concerns such an apparatus that can travel along the ground and neutralize mines in its path.

BACKGROUND OF THE INVENTION

A standard traveling rock crusher as described in my U.S. Pat. No. 5,875,980 has a vehicle body adapted to travel along the ground in a horizontal travel direction, a drum mounted at a front end of the body and rotatable about a horizontal axis generally perpendicular to the direction, an array of radially outwardly projecting chisels mounted on the drum, and a plurality of angularly spaced breaker elements mounted on the drum between the chisels. A support is mounted on the body spaced back in the direction from a rear side of the drum and carries a plurality of vertically spaced breaker bars spaced from the drum. A drive is provided for forcibly rotating the drum about the axis in a sense with a front side of the drum moving upward and the rear portion of the drum moving downward for engaging the chisels and elements with rocks on the ground, picking up the rocks, and comminuting the rocks against the breaker bars.

Such a machine is used for scarifying roadways, clearing paths in a forest, or preparing ground for agricultural use. It picks up anything lying on the ground, mainly rocks, and crushes it, depositing the crushed material back on the ground.

For clearing mines an armored vehicle is provided that has a hardened front-end attachment that serves to trip and explode mines by applying pressure or vibrations. Such devices are fairly effective with mines on or close to the surface but occasionally fail to detonate more deeply buried mines, or mines that are set to explode only when compressed by a considerable weight. For such mines a plow arrangement is typically employed which tears up the path of the mine-clearing apparatus so much that it requires a separate regrading operation to make the path passable by normal vehicles.

OBJECTS OF THE INVENTION

It is therefore an object of the present invention to provide an improved mine-clearing apparatus.

Another object is the provision of such an improved mine-clearing apparatus which overcomes the above-given disadvantages, that is which surely detonates all mines in its path and which leaves a travelable path in its wake.

A further object is to provide a new method of clearing mines.

SUMMARY OF THE INVENTION

An apparatus for clearing mines set in the ground has according to the invention a vehicle body adapted to travel along the ground in a horizontal travel direction, a drum mounted at a front end of the body and rotatable in a rotational sense about a horizontal axis generally perpendicular to the direction, and an array of radially outwardly projecting chisels mounted on the drum. A support mounted on the body spaced from the drum is at least partially displaceable on the body radially relative to the drum. Springs braced between the body and the support hold the support in a standard position at a predetermined radial spacing from the drum and permit deflection of the support radially away from drum. A plurality of vertically spaced breaker bars are mounted on the support spaced from the drum. The drum is forcibly rotated about the axis in the rotational sense with a front side of the drum moving upward and a rear side of the drum moving downward for engaging the chisels and elements with rocks and mines on and in the ground, detonating mines in the ground, picking up the rocks and undetonated mines, and comminuting the rocks and crushing the undetonated mines against the breaker bars so that a mine detonating between the drum and the support will deflect the support against the springs away from the axis.

Thus with this system most mines will be detonated on initial contact with the drum. This will do no harm to this massively built structure. Any mines that fail to detonate will be picked up and crushed, which action will either detonate them or damage them so that they cannot detonate. The detonations that occur between the drum and the support will be absorbed by the spring-mounted breaker-bar support with no damage to the apparatus. The apparatus will therefore produce a clear swathe, leaving in its wake a relatively smooth path that can be counted on to be completely safe, as any mines have either been detonated or destroyed.

The support according to the invention is pivotal on the vehicle body about a support axis generally parallel to the drum axis. Means is provided for pivoting the support about its axis toward and away from the drum. The support has an upper end above the support axis and a lower end below the support axis. The springs include upper and lower spring packs respectively braced between the body and the upper and lower ends of the support. In addition an extensible hydraulic cylinder is braced against the body and is braced via another spring against the support so that extension or retraction of the cylinder displaces the support on the body. Furthermore another spring braced between the cylinder and the body allows detonations to be absorbed without damage to the hydraulic position-setting cylinder. For further protection of this hydraulic actuator a hydraulic accumulator is connected to the cylinder so that sudden movements of the support transmitted to the cylinder can be compensated for by the accumulator.

It is also possible for the support to be generally downwardly U-shaped and fit over the drum. The springs in this case include a plurality of spring packs spaced angularly relative to the drum axis.

The method of clearing mines buried in the ground therefore comprises the steps of displacing along the ground a traveling rock crusher modified with respect to its breaker-bar support as described above, forcibly rotating its drum about the drum axis in the rotational sense with a front side of the drum moving upward and a rear side of the drum moving downward so as to engage the chisels and elements with rocks and mines on and in the ground, detonate mines in the ground, pick up the rocks and undetonated mines, and comminute the rocks and crush the undetonated mines against the breaker bars, and absorbing a detonation of a mine between the support and the drum by elastic deformation of the springs.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
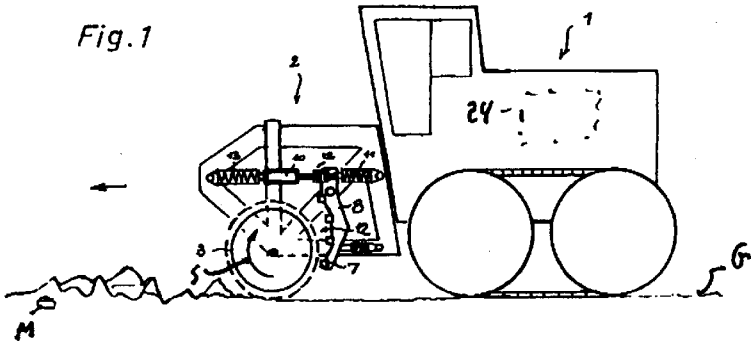
FIG. 1 is a small-scale side view of a mine-clearing apparatus according to the invention.
Figure 2:
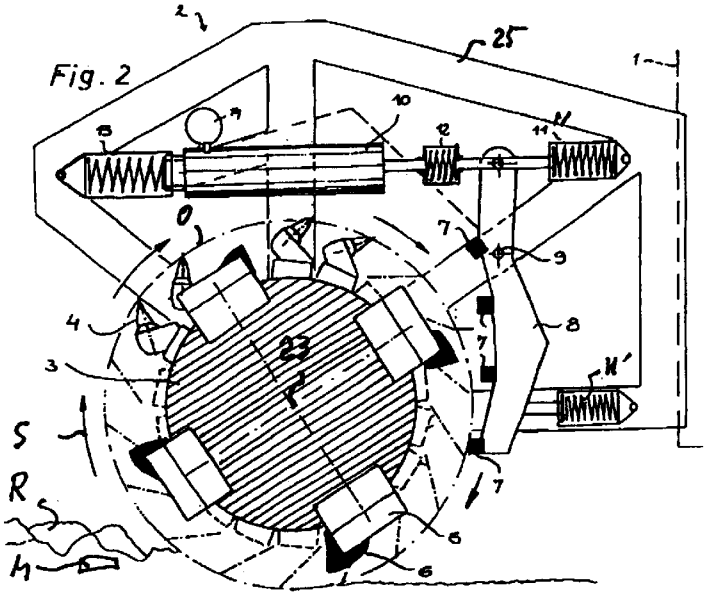
FIG. 2 is a larger-scale vertical section through the mine-clearing attachment of the apparatus of FIG. 1.

As seen in FIG. 1 a vehicle 1 normally travels via wheels 13 on the ground G in a horizontal normal travel direction D. At its front end the vehicle 1 carries a rock crusher 2 having a large cylindrical drum 3 rotated about an axis 23 by an unillustrated motor or engine illustrated schematically at 24 in a rotational sense S so that the front side of the drum 3 moves upward and its rear side moves downward.

The drum 3 carries a plurality of chisels 4 having rotatable hardened tips that are directed back in the direction S to define an orbit O as the drum 3 rotates. Spaced between and offset from the chisels 4 are breaker elements 5 having hardened metal tips 6.

According to the invention a support frame 8 is pivoted at 9 about an axis parallel to the axis 23 on a housing 25 of the crusher 2 and carries four vertically spaced square-section metal breaker bars 7 whose faces turned toward the axis 23 are tangent to an imaginary cylinder having a radius of curvature substantially greater than that of the orbit O. The uppermost bar 7 is slightly above the pivot 9 and the other three bars 7 are generally equispaced from each other below it. The lower end of this frame 8 below the pivot 9 is braced against the frame 25 by means of a horizontally effective lower spring pack 11' and the upper end of this frame 8 above the pivot 9 is braced against the frame 25 by means of a horizontally effective upper spring pack 11".

In addition a large hydraulic cylinder 10 fed from an accumulator 14 has a piston rod bearing rearward via a spring pack 12 on the upper end of the frame 8 and a front end braced forward on the frame 25 against another spring pack 13. This cylinder 10 serves to set the normal rest position of the frame and of the breaker bars 7, from which it can be deflected with compression of the spring packs 11', 11", 12, and 13.

In use as the vehicle 1 travels along the ground with the drum 3 rotating and set so that it digs down to some depth into the ground, rocks R and mines M are picked up. This will normally detonate any mines M immediately. If a mine M does not detonate, it is projected up and back along with the rocks and soil dug up by the drum 3 and thrown against the breaker bars 7 where it will either be detonated or broken against the breaker bars 7. Detonation against the breaker bars 7 will cause the frame 8 to be deflected against the springs 11, 11', 12, and 13, without any significant damage to this massively built structure. The crushed rock and other material will be dumped back onto the ground, forming a relatively smooth and safe pathway where the apparatus 1 has gone.

Figure 3:
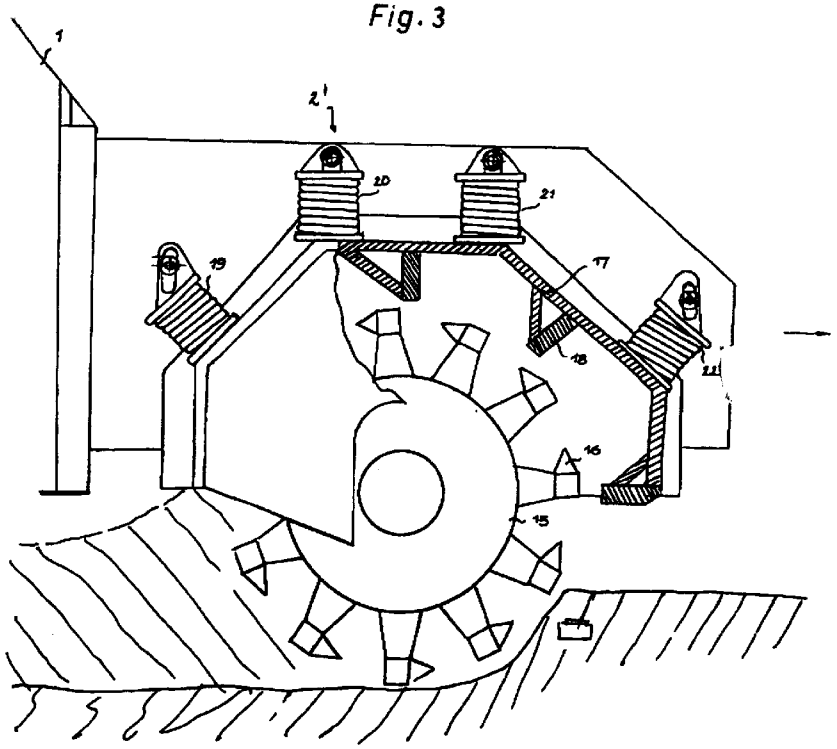
FIG. 3 is a vertical section through another mine-clearing attachment.

FIG. 3 shows another attachment 2' where a drum 15 is only provided with tangentially directed chisels 16 and where a massive U-shaped frame concentrically surrounding the drum 15 carries a plurality of breaker bars 18. Spring packs 19, 20, 21, and 22 carry the frame 17 so that it can move radially somewhat. Unillustrated side plates only reach to the normal rest position of this frame 17 so that if it is deflected upward by an explosion, it will in effect open a lateral vent that will allow the explosion to dissipate.

I claim:

1. An apparatus for clearing mines set in the ground, the apparatus comprising:

a vehicle body adapted to travel along the ground in a horizontal travel direction;

a drum mounted at a front end of the body and rotatable in a rotational sense about a horizontal axis generally perpendicular to the direction;

an array of angularly spaced chisels mounted on the drum;

a support mounted on the body spaced from the drum and at least partially displaceable on the body radially relative to the drum;

spring means braced between the body and the support for holding the support in a standard position at a predetermined radial spacing from the drum and for permitting deflection of the support radially away from the drum;

a plurality of vertically spaced breaker bars mounted on the support spaced from the drum; and means for forcibly rotating the drum about the axis in the rotational sense with a front side of the drum moving upward and a rear side of the drum moving downward for engaging the chisels and elements with rocks and mines on and in the ground, detonating mines in the ground, picking up the rocks and undetonated mines, and comminuting the rocks and crushing the undetonated mines against the breaker bars, whereby a mine detonating between the drum and the support will deflect the support against the spring means away from the axis.

2. The mine-clearing apparatus defined in claim 1 wherein the support is pivotal on the vehicle body about a support axis generally parallel to the drum axis, the apparatus further comprising means for pivoting the support about its axis toward and away from the drum.

3. The mine-clearing apparatus defined in claim 2 wherein the support has an upper end above the support axis and a lower end below the support axis, the spring means including upper and lower spring packs respectively braced between the body and the upper and lower ends of the support.

4. The mine-clearing apparatus defined in claim 2 wherein the pivoting means includes:

an extensible hydraulic cylinder braced against the body, a spring braced between the cylinder and the support, whereby extension or retraction of the cylinder displaces the support on the body.

5. The mine-clearing apparatus defined in claim 4 wherein the pivoting means further includes another spring braced between the cylinder and the body.

6. The mine-clearing apparatus defined in claim 4 wherein the pivoting means further includes a hydraulic accumulator connected to the cylinder, whereby sudden movements of the support transmitted to the cylinder can be compensated for by the accumulator.

7. The mine-clearing apparatus defined in claim 1, further comprising a plurality of angularly spaced breaker elements mounted on the drum between the chisels.

8. The mine-clearing apparatus defined in claim 1 wherein the support is generally downwardly U-shaped and fits over the drum, the spring means including a plurality of spring packs spaced angularly relative to the drum axis.

9. An apparatus for clearing mines set in the ground, the apparatus comprising:

a vehicle body adapted to travel along the ground in a horizontal travel direction;

a drum mounted at a front end of the body, having relative to the direction horizontally oppositely directed front and back sides, and rotatable in a rotational sense about a horizontal axis generally perpendicular to the direction;

an array of radially outwardly projecting chisels mounted on the drum;

a plurality of angularly spaced breaker elements mounted on the drum between the chisels;

a support mounted on the body spaced back in the direction only from the rear side of the drum and at least partially displaceable on the body radially relative to the drum;

spring means braced between the body and the support for holding the support in a standard position at a predetermined radial spacing from the drum and for permitting deflection of the support radially away from the drum;

a plurality of vertically spaced breaker bars mounted on the support spaced from the drum; and means for forcibly rotating the drum about the axis in the rotational sense with a front side of the drum moving upward and the rear side of the drum moving downward for engaging the chisels and elements with rocks and mines on and in the ground, detonating mines in the ground, picking up the rocks and undetonated mines, and comminuting the rocks and crushing the mines against the breaker bars, whereby a mine detonating between the drum and the support will deflect the support against the spring means away from the axis.

10. A method of clearing mines buried in the ground, the method comprising the steps of:

displacing along the ground a traveling rock crusher having a vehicle body adapted to travel along the ground in a horizontal travel direction, a drum mounted at a front end of the body and rotatable in a rotational sense about a horizontal axis generally perpendicular to the direction, an array of radially outwardly projecting chisels mounted on the drum, a support mounted on the body spaced from the drum and at least partially displaceable on the body radially relative to the drum, a spring braced between the body and the support, holding the support in a standard position at a predetermined radial spacing from the drum, and permitting deflection of the support radially away from the drum, and a plurality of vertically spaced breaker bars mounted on the support spaced from the drum;

forcibly rotating the drum about the axis in the rotational sense with a front side of the drum moving upward and a rear side of the drum moving downward so as to engage the chisels with rocks and mines on and in the ground, detonate mines in the ground, pick up the rocks and undetonated mines, and comminute the rocks and crush the undetonated mines against the breaker bars; and absorbing a detonation of a mine between the support and the drum by elastic deformation of the springs.

* * * * *